US005112201A

United States Patent [19]

Tamura et al.

[11] Patent Number: 5,112,201

[45] Date of Patent: May 12, 1992

[54] SCROLL COMPRESSOR APPARATUS WITH SEPARATE OIL RESERVOIR VESSEL

[75] Inventors: Takahiro Tamura, Shimizu; Kazuo Sakurai, Shizuoka, both of Japan

[73] Assignee: Hitachi, Ltd., Tokyo, Japan

[21] Appl. No.: 557,788

[22] Filed: Jul. 26, 1990

[30] Foreign Application Priority Data

Aug. 2, 1989 [JP] Japan ..... 1-199432

[51] Int. Cl.[5] ..... F04B 39/06; F04C 18/04; F04C 23/00; F04C 29/02

[52] U.S. Cl. ..... 417/366; 417/426; 418/55.6; 418/58; 418/94; 418/DIG. 1

[58] Field of Search ..... 417/366, 5, 6, 426; 418/55.6, 58, 94, 99, DIG. 1

[56] References Cited

U.S. PATENT DOCUMENTS

| | | | |
|---|---|---|---|
| 2,246,244 | 6/1941 | Consley | 417/426 |
| 4,358,254 | 11/1982 | Hannibal | 417/426 |
| 4,676,075 | 6/1987 | Shiibayashi | 418/55.6 |
| 4,795,321 | 1/1989 | Etemad et al. | 418/55.6 |

FOREIGN PATENT DOCUMENTS

| | | | |
|---|---|---|---|
| 5776201 | 5/1982 | Japan . | |
| 58-172401 | 10/1983 | Japan . | |
| 58-214690 | 12/1983 | Japan . | |
| 6187994 | 5/1986 | Japan . | |
| 63-268998 | 11/1988 | Japan | 417/366 |
| 1-77784 | 3/1989 | Japan | 417/366 |

*Primary Examiner*—John J. Vrablik

*Attorney, Agent, or Firm*—Antonelli, Terry, Stout & Kraus

[57] ABSTRACT

A scroll compressor apparatus comprising a closed scroll compressor, an oil reservoir vessel separate from the closed scroll compressor, a discharge pipe, and an oil supply pipe. The closed scroll compressor includes a closed container having a suction port through which a compression medium is suctioned, a scroll compression mechanism encased in the closed container, a motor encased in the closed container, a first oil supply passage extending through an end plate of a fixed scroll and through which a first opening facing a sliding contact portion with an orbiting scroll is communicated with an oil supply port, a second oil supply passage formed in an end plate of the orbiting scroll and through which the first opening is communicated with a second opening facing an end face of a driving shaft, and a third oil supply passage, formed in the driving shaft, through which the second opening is communicated with the third opening facing a bearing supporting the driving shaft. A discharge port is provided on the closed container at a position opposite to the scroll compression mechanism unit with respect to the motor.

2 Claims, 4 Drawing Sheets

SCROLL COMPRESSOR APPARATUS WITH SEPARATE OIL RESERVOIR VESSEL

BACKGROUND OF THE INVENTION

The present invention relates to a closed scroll compressor apparatus in which the inside of a closed container is kept at a discharge pressure, and more particularly, to cooling and lubricating systems thereof.

In a closed scroll compressor apparatus, a scroll compression mechanism unit serving to compress gas and a motor for rotatably driving the scroll compression mechanism unit are encased in a closed container, and lubricating oil is stored in a lower part of the closed container and supplied through an oil supply passage formed in a crank-shaft of the scroll compression mechanism unit to the scroll compression mechanism unit and bearings. On the other hand, compressed gas is discharged in the closed container and supplied to required portions through a discharge port formed at a position located between the scroll compression mechanism unit and the motor, the motor being cooled by the discharge gas thus passing through the closed container.

As described above, since the discharge port is provided between the scroll compressor mechanism unit and the motor, the gas discharged from the scroll compression mechanism unit flows out to the outside of the closed container without passing through a space below the motor in a vertical type compressor apparatus or without passing through a space on the opposite side to the scroll compression mechanism unit with respect to the motor in a horizontal type compressor apparatus. A problem rises in that portions located in these spaces cannot be cooled sufficiently. To solve this problem, it is considered to operate the scroll compression mechanism unit at high speed to increase the velocity of the discharge gas or to form the discharge port at a position located on the opposite side to the scroll compression mechanism with respect to the motor. However, the former method has a problem that the lubricating oil contained in the discharge gas is not separated but discharged through the discharge port, resulting in that the lubricating oil in the closed container is reduced. According to the latter method, the lubricating oil is discharged to the outside of the closed container together with the discharge gas to bring about a shortage of the lubricating oil in case of the vertical type compressor. In case of the horizontal type compressor, the lubricating oil stored in the lower part of the closed container is made to flow toward the discharge port due to a pressure difference in the closed container, resulting in the shortage of the lubricating oil along the oil supply passage and hence the insufficient lubrication. This adverse condition becomes more noticeable at high speed operation. For this reason, the scroll compressor apparatus of the prior art is operated at a relatively low speed and formed with the discharge port at the above-mentioned position although the cooling effect cannot be achieved satisfactorily.

In order to lubricate every portion of the compressor apparatus sufficiently, it is better that a large quantity of lubricating oil be stored in the closed container. However, with a large stored quantity of lubricating oil in the lower part of the closed container, a rotor of the motor stirs the lubricating oil, resulting in the loss of power of the motor. For this reason, the lubricating oil is permitted to be stored only up to the lower end of the rotor. In other words, to store a large quantity of lubricating oil, it is necessary to increase the size of the closed container.

Further, in the compressor apparatus of the type that the lubricating oil is stored in the closed container, when the compressor apparatus is brought to a halt, the pressure in the closed container is somewhat lowered so that the discharge gas dissolves in the lubricating oil stored in the closed container. As a result, when the compressor apparatus is restarted, the discharge gas thus dissolved results in foaming. Upon occurrence of the foaming, foamed lubricating oil is supplied to the bearings, resulting in an insufficient supply of the lubricating oil to the bearings resulting in a potential bearing seizure.

On the other hand, in case of the horizontal type compressor apparatus, since a stator of the motor is partially submerged in the lubricating oil stored in the lower part of the closed container, there is a possibility that the sheath of wire of the stator is damaged by iron dust or the like contained in the lubricating oil to cause a burnout of the stator.

In addition, a variable capacity scroll compressor apparatus comprises a plurality of closed scroll compressors which are connected in parallel manner to a common suction pipe and a common discharge pipe, and a plurality of oil equalizing pipes through which lower parts of the closed containers of the respective compressors are communicated with each other for equalizing the quantities of lubricating oil stored in the closed containers. In the variable capacity scroll compressor apparatus, the overall capacity is controlled by making inoperative some of the plural compressors. This variable capacity scroll compressor apparatus has the following problems in addition to the disadvantages described above.

When all the compressors are operated, internal pressures in the closed containers of all the compressors are not substantially equalized with each other due to the manufacturing differences among the individual compressors, pipes and the like. For this reason, the quantity or lubricating oil in each compressor is not uniform, thereby causing nonuniform distribution of the lubricating oil among the compressors. As a result, the compressor which is lacking in lubricating oil is not lubricated sufficiently, thereby resulting in bearing seizure. Meanwhile, when the compressor apparatus is operated in a capacity controlling mode in which some of the compressors are made inoperative, since the internal pressure in the closed container of the inoperative compressor is lower than that of the compressor which is in operation, the lubricating oil flows from the compressor in operation into the inoperative compressor, thereby causing non-uniform distribution of the lubricating oil. Further, there is a problem that a part of discharge gas compressed by the compressor in operation flows into the inoperative compressor and dissolves in the lubricating oil in the inoperative compressor to dilute the lubricating oil. In addition, when the inoperative compressor is started again, there is a problem that the discharge gas thus dissolved results in foaming.

SUMMARY OF THE INVENTION

An object of the present invention is to provide a closed scroll compressor apparatus which can be operated at high speed, which can ensure a sufficient quantity of lubricating oil without any loss of power of a motor nor increasing the size of a closed container, which is freed from occurrence of any foaming, and in which every part of a compressor can be lubricated reliably and the motor can be cooled surely.

Another object of the present invention is to provide a variable capacity closed scroll compeessor apparatus which can be operated at high speed, which can ensure a sufficient quantity of lubricating oil without any loss of power of a motor nor increasing the size of a closed container, which is freed from nonuniform distribution of lubricating oil between compressors and occurrence of any foaming, and in which every part of the compressor can be lubricated reliably and the motor can be cooled surely.

A closed scroll compressor apparatus according to the present invention comprises a closed scroll compressor, an oil reservoir vessel which is separate from the closed scroll compressor and which accommodates compressed compression medium and lubricating oil, a discharge pipe through which a discharge port of the closed scroll compressor is communicated with a part of the oil reservoir vessel in which the compression medium is accommodated, and an oil supply pipe through which an oil supply port of the closed scroll compressor is communicated with another part of the oil reservoir vessel in which the lubricating oil is accommodated.

The closed scroll compressor comprises a closed container having a suction port through which the compression medium is suctioned, a scroll compression mechanism unit encased in the closed container for serving to compress the compression medium and having a fixed scroll, an orbiting scroll and a driving shaft for driving rotatively the moveable scroll, a motor encased in the closed container for rotatably driving the driving shaft, a first oil supply passage which extends through an end plate of the fixed scroll and through which a first opening facing a slide contact portion with the orbiting scroll is communicated with the oil supply port, a second oil supply passage which is formed in an end plate of the orbiting scroll and through which the first opening is communicated with a second opening facing an end face of the driving shaft, and a third oil supply passage formed in the driving shaft and through which the second opening is communicated with a third opening facing a bearing supporting the driving shaft.

The discharge port is provided on the closed container at a portion located on the opposite side to the scroll compression mechanism unit with respect to the motor.

A variable capacity closed scroll compressor apparatus according to the present invention comprises a plurality of closed scroll compressors which are connected in parallel manner to a common suction pipe and a common discharge pipe, an oil reservoir vessel separate from the plurality of closed scroll compressors and accommodating compressed compression medium and lubricating oil, a plurality of discharge pipes through which respective discharge ports of the plurality of closed scroll compressors are communicated with the common discharge pipe connected with a part of the oil reservoir vessel in which the compression medium is accommodated, with each discharge pipe having a check valve for preventing the compression medium from flowing into the closed scroll compressor, and a plurality of oil supply pipes through which respective oil supply ports of the plurality of closed scroll compressors are communicated with a common oil supply pipe connected with another part of the oil reservoir vessel in which the lubricating oil is accommodated, each oil supply pipe having a stop valve which is capable of closing the oil supply pipe.

Each of the plurality of closed scroll compressors comprises a closed container having a suction port through which the compression medium is suctioned, a scroll compression mechanism unit encased in the closed container for serving to compress the compression medium and having a fixed scroll, an orbiting scroll and a driving shaft for driving rotatively the moveable scroll, a motor encased in the closed container for rotatably driving the driving shaft, a first oil supply passage which extends through an end plate of the fixed scroll and through which a first opening facing a slide contact portion with the orbiting scroll is communicated with the oil supply port, a second oil supply passage formed in an end plate of the orbiting scroll and through which the first opening is communicated with a second opening facing an end face of the driving shaft, and a third oil supply passage formed in the driving shaft and through which the second opening is communicated with a third opening facing a bearing supporting the driving shaft.

The discharge port is provided on the closed container at a portion located on the opposite side to the scroll compression mechanism unit with respect to the motor.

In accordance with the present invention, since the oil reservoir in which the lubricating oil is stored is provided separately from the closed scroll compressor, there are no possibility that the lubricating oil is reduced even when the compressor apparatus is operated at high speed. It is therefore possible to lubricate every portion of the compressor without omission. Further, there is no foaming. It is also possible to maintain a sufficient quantity of lubricating oil without increasing the size of the closed container. In addition, since the closed container is provided with the discharge port at a position located on the opposite side to the scroll compression mechanism unit with respect to the motor, the discharge gas from the scroll compression mechanism unit reaches the whole of the motor without omission to cool the motor with reliability.

Further, in accordance with the present invention, the lubricating oil is stored in the common oil reservoir separate from a plurality of scroll compressors, and is supplied therefrom to the respective compressors for lubrication. Therefore, the lubricating oil is prevented from being nonuniformly distributed between the compressors both when all the compressors are operated and when the compressor apparatus is operated in a capacity controlling mode. Further, there is no foaming when the inoperative compressor is restarted. In addition, when the compressor apparatus is operated in a capacity controlling mode, the inoperative scroll compressor is isolated from the scroll compressor in operation within the circuit, so that the lubricating oil is prevented from being supplied to the inoperative scroll compressor. Therefore, there are no possibility that the inoperative compressor is hindered from being started again.

DESCRIPTION OF THE PREFERRED EMBODIMENTS

Figure 1:
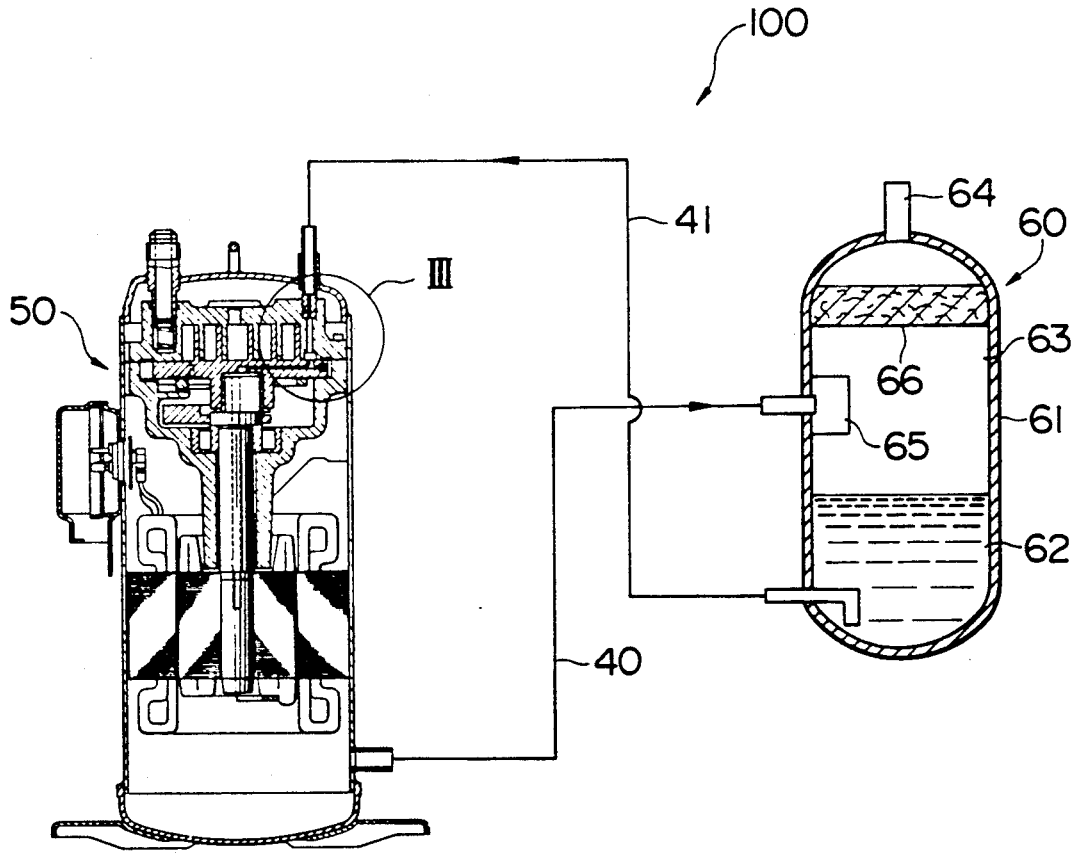
FIG. 1 is a sectional view of a vertical type closed scroll compressor apparatus according to an embodiment of the present invention.
Figure 2:
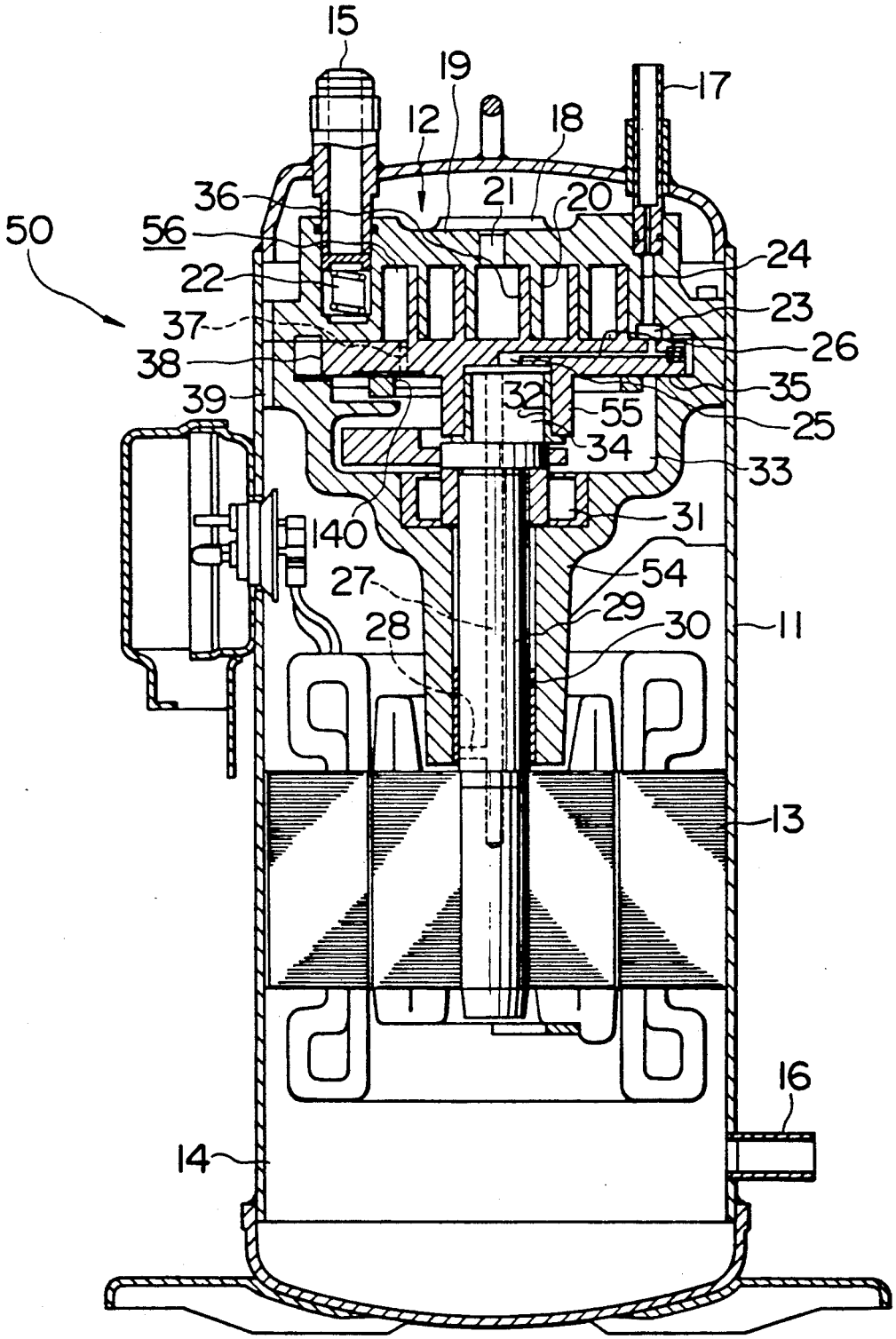
FIG. 2 is a sectional view of a closed scroll compressor of the closed scroll compressor apparatus shown in FIG. 1.
Figure 3:
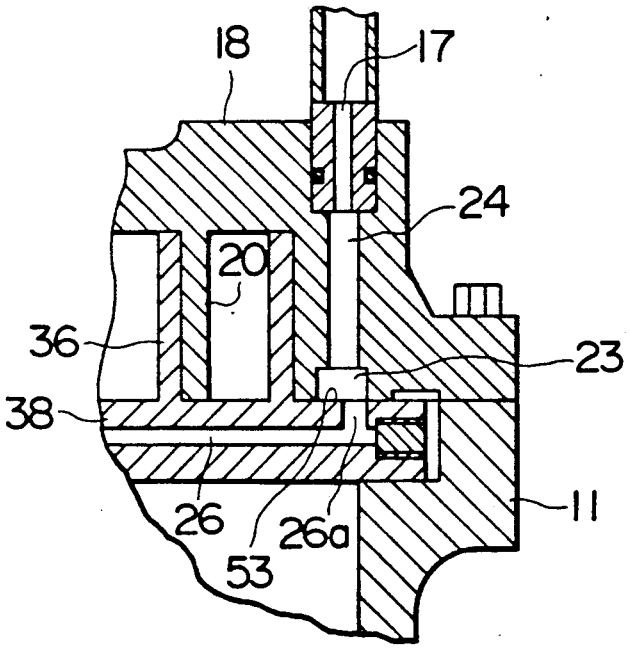
FIG. 3 is an enlarged sectional view of a part III of FIG. 1.

Description will be given below of a vertical type closed scroll compressor apparatus according to an embodiment of the present invention with reference to FIGS. 1 to 3.

A closed scroll compressor apparatus 100 comprises a vertical scroll compressor 50 and an oil reservoir 60 provided separately from the closed scroll compressor 50. The closed scroll compressor 50 has a closed container 11 which is formed on an upper portion thereof with a suction port 15 and an oil supply port 17 and which encases a scroll compression mechanism unit 12 and a motor 13 for rotatively driving the scroll compression mechanism unit 12. A lower space 14 is provided below the motor 13.

The scroll compression mechanism unit 12 comprises a fixed scroll 18, an orbiting scroll 55 which is engaged with the fixed scroll 18, a driving shaft 29 which is rotated by the motor 13, and a turning preventing mechanism 140 which prevents the orbiting scroll 55 from turning on its axis.

The fixed scroll 18 is fixed by means of a frame 54 fixed to the closed container, and comprises an end plate 19 and a spiral wrap 20 provided on the end plate 19. A suction inlet 22 is provided at an outer peripheral portion of the wrap 20, with the suction inlet 22 being in communication with the suction port 15. A discharge outlet 21 is formed at the center of the end plate 19 so that gas compressed by the scroll compression mechanism unit 12 is discharged through the discharge outlet 21 into the closed container 11.

The orbiting scroll 55 also has a spiral wrap 36 provided on an end plate 38, the wrap 36 being engaged with the wrap 20 of the fixed scroll 18. A bearing 32 is provided at the back of the end plate 38, and a crankpin 34 for the driving shaft 29 is inserted in the bearing 32.

The driving shaft 29 is rotatably supported by bearings 30 and 31 provided in the frame 54, and is provided at an end portion thereof with the crankpin 34. The driving shaft 29 is connected with a rotor of the motor 13 disposed below the scroll compression mechanism unit 12 so that it is rotated by the motor 13.

The frame 54, fixed to the closed container 11, is formed therein with a pedestal 35 which cooperates with the fixed scroll 18 to hold the moveable scroll 55 therebetween, and a back pressure chamber 33 which serves to apply a proper pressing force on the moveable scroll 55. The back pressure chamber 33 is communicated with a compression space 56 which is on the way of a compression stroke through an equalizing hole 37 formed in the end plate 38 of the moveable scroll 55. Therefore, the back pressure chamber 33 is maintained at an intermediate pressure between the suction pressure and the discharge pressure so as to serve to press the moveable scroll 55 against the fixed scroll 18 at a proper pressing force. The turning preventing mechanism 40 serving to prevent the moveable scroll 55 from turning on its axis is provided between the rear surface of the moveable scroll 55 and the frame 54. A gas passage 39 is formed to extend through the end plate 19 of the fixed scroll 18 and the frame 54 so that the compressed gas discharged through the discharge outlet 21 of the scroll compression mechanism unit 12 flows through the gas passage 39 into the motor 13 disposed in the lower part of the closed container 11 and into the lower space 14. The closed container 11 is provided with a discharge port 16 at a position thereof located on the opposite side to the scroll compression mechanism unit 12 with respect to the motor 13, the discharge port 16 being communicated with the lower space 14.

The oil reservoir 60 has an oil reservoir vessel 61 which is formed at a top portion thereof with a gas supply port 64. In the oil reservoir vessel 61, there are provided an oil separator 65 for separating the lubricating oil from the compressed gas and an oil trap 66 for preventing the lubricating oil from flowing out of the oil reservoir vessel 61 together with the compressed gas. The oil separator 65 and the discharge port 16 are communicated with each other by a discharge pipe 40, and a portion 62 in the lower part of the oil reservoir vessel 61 in which the lubricating oil is stored is communicated with the oil supply port 17 by means of an oil supply pipe 41.

A first opening 23 is formed in the end plate 19 of the fixed scroll 18 at a portion facing a slide contact portion with the moveable scroll 55, and the first opening 23 and the oil supply port 17 are communicated with each other by a first oil supply passage 24 which extends through the end plate 19 of the fixed scroll 18. A second opening 25 is formed in the end plate 38 of the orbiting scroll 55 at a portion facing the crankpin 34, and a second oil supply passage 26 through which the first opening 23 is communicated with the second opening 25 is further formed in the end plate 38. As shown in FIG. 3 as the orbiting scroll 55 is rotated, the center **26*a* of the second oil supply passage 26 is moved in a circle with the same radius as the crank radius of the crankpin 34, that is, as the rotating radius of the orbiting scroll 55. The size of the fist opening 23 is so determined as to allow the first opening 23 to be communicated with the second oil supply passage 26 constantly during the rotating movement. Namely, the radius of the first opening 23 is larger than a difference obtained by subtracting the radius of the second oil supply passage 26 from the rotating radius. A third opening 28 is formed in the driving shaft 29 at a portion facing the bearing 30, and a third oil supply passage 27 through which the third opening 28 is communicated with the second opening 25 is further formed in the driving shaft 29** substantially along its center axis.

As the driving shaft 29 is rotated by the motor 13, the orbiting scroll 55 is moved in a rotating motion without turning on its axis by virtue of the rotating motion of the crankpin 34 and by the action of the turning preventing mechanism 140. As a result, the compression space defined by the wraps 36, 20 and the end plates 38, 19 of the orbiting scroll 55 and the fixed scroll 18 is moved toward the center of the fixed scroll 18 while its volume is being reduced, so that the gas suctioned from the suction inlet 22 is compressed and the discharged through the discharge outlet 21. The compressed gas thus discharged flows downward through the gas passage 39 extending through the end plate 29 of the fixed scroll 18 and the frame 54 to the lower part of the closed container 11 so as to cool the entire motor 13. Thereafter, the gas is discharged through the discharge port 16 to be sent to the oil reservoir 60.

The discharge gas, sent from the scroll compressor 50, is separated from the lubricating oil by means of the oil separator 65 and then stored at the discharge pressure in an upper part 63 of the oil reservoir vessel 61. Thereafter the gas is supplied through the gas supply port 64 to the required portions. The lubricating oil thus separated is stored in the lower part 62 of the oil reservoir vessel 61. The lubricating oil stored at the discharge pressure is sent through the oil supply pipe 41 to the oil supply port 17 from which the lubricating oil is sent to the second opening 25 via the first oil supply passage 24, the first opening 23 and the second oil supply passage 26. The lubricating oil is further sent to the third opening 28 through the third oil supply passage 27. Portions of the bearings 32 and 31 adjacent to the back pressure chamber are kept at the intermediate pressure which is lower than the discharge pressure, so that the lubricating oil is made to flow to the respective bearings 30 and 32 due to the pressure difference so as to lubricate them. The bearing 31 is lubricated by the lubricating oil having been used for lubricating these bearings 30 and 32.

After lubricating the respective bearings, the lubricating oil flows downward to the lower space 14 of the closed container 11 to be returned to the oil reservoir 60 together with the discharge gas.

In the embodiment described above, since the oil reservoir in which the lubricating oil is stored is provided separately from the closed scroll compressor, there is no possibility that the lubricating oil is reduced even when the compressor apparatus is operated at high speed. It is therefore possible to lubricate every portion of the compressor without omission. Further, there is no foaming. It is also possible to maintain a sufficient quantity of lubricating oil without increasing the size of the closed container. In addition, since the closed container is provided with the discharge port at a position located on the opposite side to the scroll compression mechanism unit with respect to the motor, the discharge gas from the scroll compression mechanism unit reaches the whole of the motor without omission to cool the motor with reliability.

Figure 4:
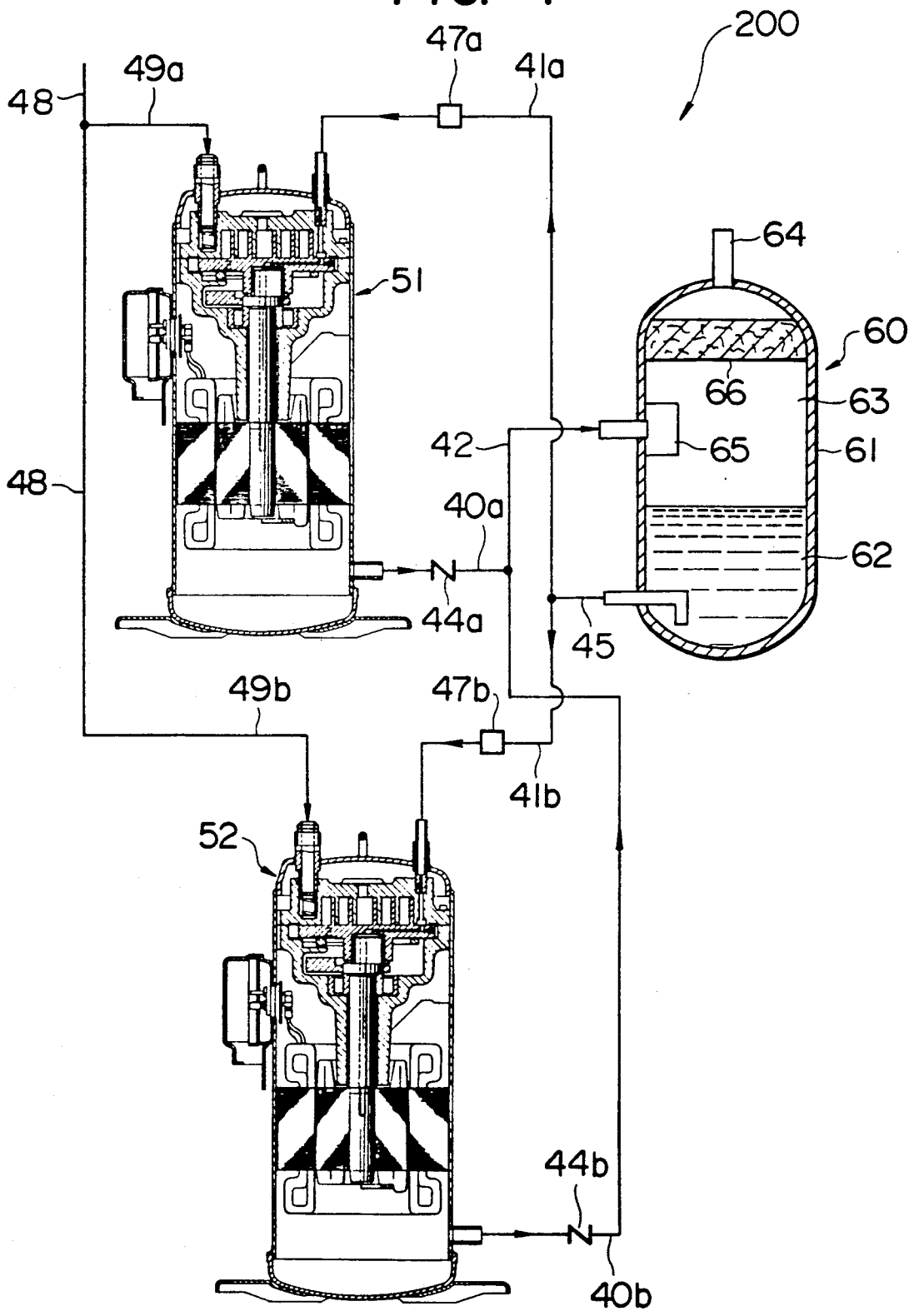
FIG. 4 is a sectional view of a vertical type variable capacity closed scroll compressor apparatus according to another embodiment of the present invention.

Next, description will be given of a vertical type variable capacity closed scroll compressor apparatus according to another embodiment of the present invention with reference to FIG. 4.

A variable capacity closed scroll compressor apparatus 200 comprises two scroll compressors 51, 52 which are connected in parallel manner to a common suction pipe 48 and a common discharge pipe 42 by suction pipes 49*a*, 49*b* and discharge pipes 40*a*, 40*b*, respectively, and an oil reservoir 60 provided separately from these compressors 51 and 52. Constructions and functions of the scroll compressors 51, 52 and the oil reservoir 60 are identical with those of the aforesaid embodiment so that explanation thereof will be omitted, but portions different from the above embodiment will be explained. The common discharge pipe 42 is connected with an upper part 63 of the oil reservoir 60 in which the discharge gas is stored. The discharge ports 16 are communicated with the common discharge pipe 42 by the discharge pipes 40*a* and 40*b*. The discharge pipes 40*a* and 40*b* are provided with check valves 44*a* and 44*b*, respectively, in such a manner as to prevent the discharge gas from flowing backward. Further, a common oil supply pipe 45 is connected with a lower part 62 of the oil reservoir 60 in which the lubricating oil is stored. The oil supply ports 17 are communicated with the common oil supply pipe 45 by oil supply pipes 41*a* and 41*b*. The oil supply pipes 41*a* and 41*b* are provided with stop valves 47*a* and 47*b* each serving to close the oil supply pipe, respectively.

When all the compressors 51 and 52 are operated, the discharge gas, having been used to cool the motors of the compressors 51 and 52, is sent to the oil reservoir 60 through the discharge pipes 40*a*, 40*b* and through the common discharge pipe 42, and is then separated from the lubricating oil by the oil separator 65 so as to be stored in the upper part 63 of the oil reservoir vessel 61 at the discharge pressure. The discharge gas from the compressor 51 is prevented from flowing into the compressor 52 by means of the check valve 44*b*, while the discharge gas from the compressor 52 is prevented from flowing into the compressor 51 by the check valve 44*a*. The lubricating oil stored in the lower part 62 of the oil reservoir vessel 61 is sent to the oil supply ports 17 of the respective compressors 51 and 52 via the common oil supply pipe 45 and the respective oil supply pipes 41*a* and 41*b*, so as to lubricate the bearings in the same manner as the above embodiment. Subsequently, the lubricating oil is returned to the oil reservoir 60 together with the discharge gas.

When the compressor apparatus is operated in a capacity controlling mode in which one of the compressors or the compressor 52, for example, is made inoperative, the stop valve 47*b*, disposed in the oil supply pipe 41*b* of the compressor 52, is closed. Since the discharge gas from the compressor 51 is prevented from flowing into the compressor 52 by the check valve 44*b*, it is sent to the oil reservoir 60 through the common discharge pipe 42 and then separated from the lubricating oil by the oil separator 65 so as to be stored in the upper part 63 of the oil reservoir vessel 61 at the discharge pressure. The lubricating oil stored in the lower part 62 of the oil reservoir vessel 61 is sent to the oil supply pipe 41*b* through the common oil supply pipe 45, but it is not allowed to flow into the compressor 52 because the stop valve 47*b* is closed. On the other hand, since the stop valve 47*a* is opened, the lubricating oil is sent to the oil supply port 17 of the compressor 51 via the common oil supply pipe 45 and the oil supply pipe 41*a*, so as to serve to lubricate the bearings in the same manner as the above embodiment. Subsequently, the lubricating oil is returned to the oil reservoir 60 together with the discharge gas.

In the present embodiment, the lubricating oil is stored in the common oil reservoir which is separate from a plurality of scroll compressors, and is supplied therefrom to the respective compressors for lubrication. Therefore, the lubricating oil is prevented from being nonuniformly distributed between the compressors both when all the compressors are operated and when the compressor apparatus is operated in a capacity controlling mode. Further, there is no foaming when the inoperative compressor is started again. In addition, when the compressor apparatus is operated in a capacity controlling mode, the inoperative scroll compressor is isolated from the scroll compressor in operation within the circuit, so that the lubricating oil is prevented from being supplied to the inoperative scroll compressor. Therefore, it is prevented that the compression space in the scroll compression mechanism unit is filled with the lubricating oil while the scroll compressor is made inoperative and the inoperative compressor is prohibited from being started again due to liquid compression.

The above embodiments have been described in connection with the compressor apparatus including what is called vertical type scroll compressor in which the scroll compression mechanism unit and the driving shaft for driving this unit are arranged vertically. However, the present invention is applicable to the compressor apparatus including what is called horizontal type scroll compressor in which the scroll compression mechanism unit and the driving shaft for driving to is unit are arranged horizontally in the closed container.

What is claimed is:

1. A scroll compressor apparatus comprising:

a closed scroll compressor;

an oil reservoir vessel separate from said closed scroll compressor and accommodating compressed compression medium and a lubricating oil;

a discharge pipe through which a discharge port of said closed scroll compressor is communicated with a part of said oil reservoir vessel in which the compression medium is accommodated; and an oil supply pipe through which an oil supply port of said closed scroll compressor is communicated with another part of said oil reservoir vessel in which the lubricating oil is accommodated, said closed scroll compressor comprising:

a closed container having a suction port through which the compression medium is suctioned;

a scroll compression mechanism unit encased in said closed container for compressing the compression medium and having a fixed scroll, an orbiting scroll and a driving shaft for rotatably driving said orbiting scroll;

a motor encased in said closed container for rotatably driving said driving shaft;

a first oil supply passage extending through an end plate of said fixed scroll and through which a first opening facing a sliding contact portion with said orbiting scroll is communicated with said oil supply port;

a second oil supply passage formed in an end plate of said orbiting scroll and through which said first opening is communicated with a second opening facing an end face of said driving shaft; and a third oil supply passage formed in said driving shaft and through which said second opening is communicated with a third opening facing a bearing supporting said driving shaft, wherein said discharge port is provided on said closed container at a portion located on the opposite side to said scroll compression mechanism unit with respect to said motor.

2. A variably capacity scroll compressor comprising:

a plurality of closed scroll compressors connected in parallel to a common suction pipe and a common discharge pipe;

an oil reservoir vessel separate from said plurality of closed scroll compressors and accommodating compressed compression medium and lubricating oil;

a plurality of discharge pipes through which the respective discharge ports of said plurality of closed scroll compressors are communicated with said common discharge pipe connected with a part of said oil reservoir vessel in which the compression medium is accommodated, each discharge pipe having a check valve for preventing the compression medium from flowing into the closed scroll compressor; and a plurality of oil supply pipes through which respective oil supply ports of said plurality of closed scroll compressors are communicated with a common oil supply pipe connected with another part of said oil reservoir vessel in which the lubricating oil is accommodated, said plurality of oil supply pipes each having a stop valve which is capable of closing the respective oil supply pipe, each of said plurality of closed scroll compressors comprising:

a closed container having a suction port through which the compression medium is suctioned;

a scroll compression mechanism unit encased in said closed container for compressing the compression medium and having a fixed scroll, an orbiting scroll and a driving shaft for rotatably driving said orbiting scroll;

a motor encased in said closed container for rotatably driving said driving shaft;

a first oil supply passage extending through an end plate of said fixed scroll and through which a first opening facing a slide contact portion with said orbiting scroll is communicated with said oil supply port;

a second oil supply passage formed in an end plate of said orbiting scroll and through which said first opening is communicated with a second opening facing an end face of said driving shaft; and a third oil supply passage formed in said driving shaft and through which said second opening is communicated with a third opening facing a bearing supporting said driving shaft, wherein said discharge port is provided on said closed container at a portion located on the opposite side to said scroll compression mechanism unit with respect to said motor.

* * * * *